US007307489B2

(12) United States Patent
Aoki

(10) Patent No.: US 7,307,489 B2
(45) Date of Patent: Dec. 11, 2007

(54) NON-RECIPROCAL CIRCUIT ELEMENT

(75) Inventor: Kazuyuki Aoki, Tokyo (JP)

(73) Assignee: TDK Corporation, Tokyo (JP)

( * ) Notice: Subject to any disclaimer, the term of this patent is extended or adjusted under 35 U.S.C. 154(b) by 201 days.

(21) Appl. No.: 11/110,714

(22) Filed: Apr. 21, 2005

(65) Prior Publication Data

US 2005/0242899 A1 Nov. 3, 2005

(30) Foreign Application Priority Data

Apr. 22, 2004 (JP) ..... 2004-127239

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

2002/0053964 A1* 5/2002 Makino et al. ..... 335/229

2002/0121942 A1* 9/2002 Matsuoka et al. ..... 333/24.2

FOREIGN PATENT DOCUMENTS

JP 2001-177308 6/2001

OTHER PUBLICATIONS

Patent Abstracts of Japan, JP 2002-111320, Apr. 12, 2002.

* cited by examiner

*Primary Examiner*—Stephen E. Jones
(74) *Attorney, Agent, or Firm*—Oblon, Spivak, McClelland, Maier & Neustadt, P.C.

(57) ABSTRACT

A magnetic rotor includes a soft ferrite substrate and a plurality of central conductors. The magnetic rotor is provided inside a casing. A permanent magnet is provided inside the casing, and disposed to overlap the magnetic rotor so as to apply a DC magnetic field to the magnetic rotor. The casing includes a magnetic metal material. The casing is coupled with the permanent magnet so as to form a yoke. A coupling portion is formed in a direction crossing a magnetic circuit of the yoke. The casing is coupled in a direction of the magnetic circuit through the coupling portion. The coupling portion includes a capacitance element which has high impedance in response to a DC current and has low impedance in response to a high frequency current.

7 Claims, 10 Drawing Sheets

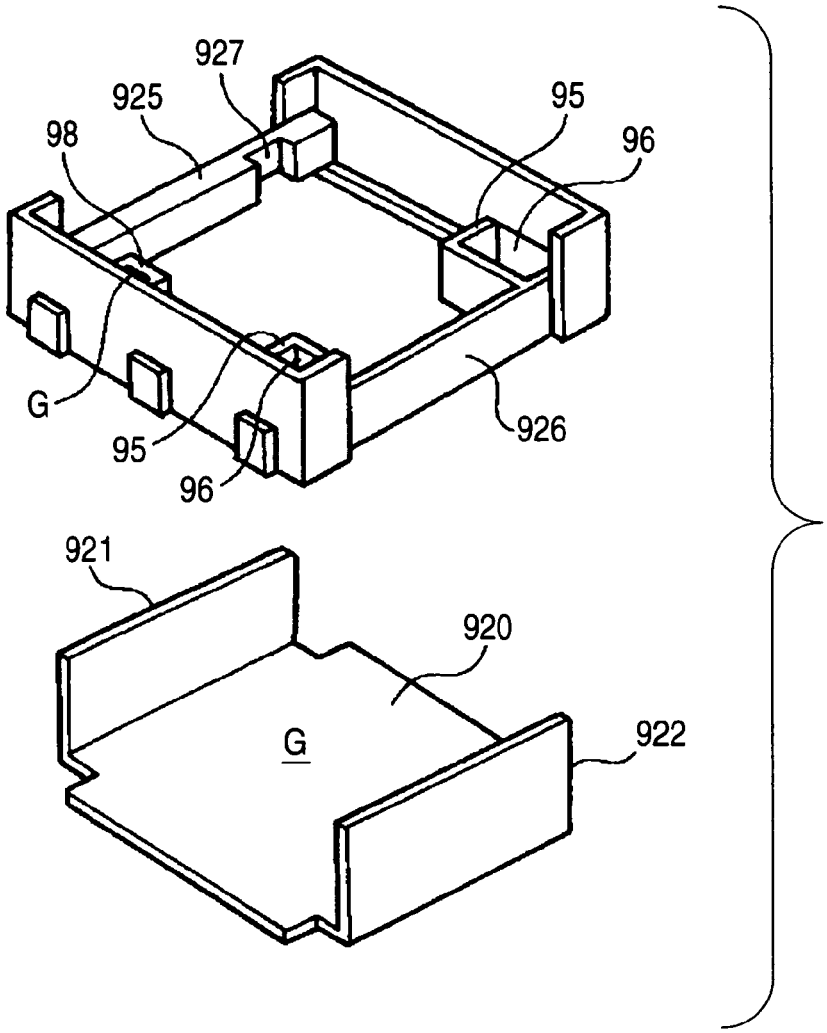
FIG. 3
FIG. 4
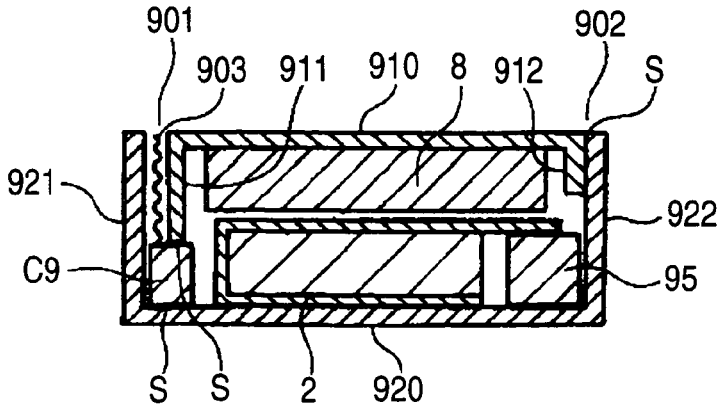

NON-RECIPROCAL CIRCUIT ELEMENT

BACKGROUND OF THE INVENTION

The present invention relates to a non-reciprocal circuit element such as an isolator or a circulator.

Non-reciprocal circuit elements such as isolators or circulators are used in mobile wireless equipments such as cellular phones. Such a non-reciprocal circuit element is constituted by accommodating magnetic parts and electric parts in a magnetic metal casing serving as a yoke. The magnetic parts include a magnetic rotor constituted by a soft ferrite substrate, a central electrode, etc., a permanent magnet, and so on. The electric parts include a matching capacitor, a terminating resistor, and so on.

The soft ferrite substrate is combined with the central electrode so that a DC magnetic field is applied from the permanent magnet to the soft ferrite substrate. The central electrode includes a plurality of central conductors. One end of the central electrode is disposed on one surface of the soft ferrite substrate so as to be grounded as a ground portion on the metal casing. The central conductors are disposed on the other surface of the soft ferrite substrate so as to be insulated from one another while crossing one another at a predetermined angle. The front end of each central conductor is connected to an electric part such as a matching capacitor or a terminating resistor, and extracted to the outside of the metal casing so as to serve as an external terminal.

The market demands to miniaturize such a non-reciprocal circuit element infinitely. The present dimensions of the non-reciprocal circuit element have been reduced to be 4 mm square or smaller. With this miniaturization, the magnetic rotor or the permanent magnet constituting the non-reciprocal circuit element has been improved to be smaller in size and lower in profile. Thus, those parts have been mounted in high density in the metal casing. In addition, recently, the operating frequency band of such a non-reciprocal circuit element has reached a GHz band. When the non-reciprocal circuit element mounted thus in high density is operated by a high frequency signal, there occurs a problem that a high frequency current is generated in the metal casing.

That is, in the aforementioned non-reciprocal circuit element, a magnetic metal material forming the casing is disposed around the magnetic rotor and the permanent magnet and in close contact. Therefore, when a high frequency signal is supplied to the central conductors constituting the magnetic rotor, a high frequency current is induced in the casing due to an inductance component of the central conductors and an inductance component of the casing. This high frequency current is wasted as Joule loss. On the other hand, the high frequency current orbiting the casing acts to cancel the signal flowing in the central conductors. Thus, the high frequency magnetic field of the magnetic rotor is weakened to degrade the electric characteristic of the non-reciprocal circuit element.

In order to solve such a problem, for example, JP-A-2001-177308 discloses a technique in which ferrite and a gap for blocking an orbiting current (high frequency current) flowing around a central electrode are provided in a metal casing. Further improvement in the characteristic is, however, desired.

SUMMARY OF THE INVENTION

It is an object of the present invention to provide a non-reciprocal circuit element having an electric characteristic improved in view of insertion loss, input/output V.S.W.R. (voltage standing wave ratio) bandwidth, etc.

In order to solve the foregoing problem, a non-reciprocal circuit element according to the invention includes a magnetic rotor, a permanent magnet and a casing. The magnetic rotor includes a soft ferrite substrate and a plurality of central conductors, and is provided inside the casing. The permanent magnet is provided inside the casing, and is disposed to overlap the magnetic rotor, so as to apply a DC magnetic field to the magnetic rotor. The casing includes a magnetic metal material, and is coupled with the permanent magnet so as to form a yoke. A coupling portion is formed in a direction crossing a magnetic circuit of the yoke so that the casing is coupled with the permanent magnet in a direction of the magnetic circuit through the coupling portion. The coupling portion includes a capacitance element which has high impedance in response to a DC current and has low impedance in response to a high frequency current.

In the aforementioned non-reciprocal circuit element, the magnetic rotor and the permanent magnet are provided inside the casing. The casing includes a magnetic metal material and is coupled with the permanent magnet so as to form a yoke. Accordingly, around the magnetic rotor and the permanent magnet, an orbiting circuit is formed in the direction of the magnetic circuit of the yoke.

The permanent magnet is disposed to overlap the magnetic rotor, and the magnetic rotor includes a plurality of central conductors and a soft ferrite substrate. Accordingly, when a high frequency signal is supplied to the plurality of central conductors, a high frequency current is induced in the casing due to the inductance component belonging to the central conductors and the inductance component belonging to the casing.

The coupling portion is formed in a direction crossing the magnetic circuit of the yoke so that the casing is coupled in the direction of the magnetic circuit through the coupling portion. The coupling portion includes a capacitance element which has high impedance in response to a DC current and have relatively low impedance in response to a high frequency current. It has been proved that the configuration of the casing according to the invention improves the input/output V.S.W.R. (voltage standing wave ratio), reduces the insertion loss and expands the operating frequency bandwidth.

That is, in the configuration of the casing according to the invention, the capacitance element is inserted to the orbiting circuit formed in the direction of the magnetic circuit of the yoke, so as to be in series with the inductance component belonging to the casing. Thus, a resonance circuit is formed in the casing. It is estimated that the electric characteristic is improved due to this resonance circuit.

The configuration of the casing according to the invention is different from the configuration generally used in the background art, in which upper and lower casings are coupled by soldering, and a coupling portion having low impedance both in response to a DC current and in response to a high frequency current, or the configuration in which ferrite and a gap for blocking an orbiting current (high frequency current) flowing around a central electrode are provided in a metal casing as shown in Patent Document 1.

The capacitance element used as the coupling portion in the casing according to the invention can be formed out of a capacitor element such as a multilayer capacitor, a single-plate capacitor, or a capacitor formed by use of a low-temperature co-fired ceramic technique, or can be formed out of a dielectric sheet or an insulating coating layer inserted into the coupling portion. In the case where a capacitor element is used, it can be selected from capacitor elements having various capacitance values. Thus, the design becomes easy. In the case where a dielectric sheet or an insulating coating layer is used, the capacitance value can be set by changing the area of opposed surfaces when the magnetic metal material surfaces of the casing are used as opposed electrodes. Further, fixation of the coupling portion can be attained together when an adhesive agent or an adhesive or tacky sheet is used together.

In such a manner, according to the invention, it is possible to obtain a non-reciprocal circuit element having an electric characteristic improved in view of insertion loss, input/output V.S.W.R., bandwidth, etc.

BRIREF DESCRIPTION OF THE DRAWINGS

FIG. 3 is an exploded perspective view of a lower casing in the non-reciprocal circuit element shown in FIGS. 1 and 2.

FIG. 4 is a schematic sectional view of the non-reciprocal circuit element shown in FIGS. 1 to 3.

DETAILED DESCRIPTION OF THE PREFERRED EMBODIMENTS

The other objects, configurations and advantages of the invention will be described more in detail with reference to the accompanying drawings. However, the accompanying drawings are simply exemplary illustrations.

Figure 1:
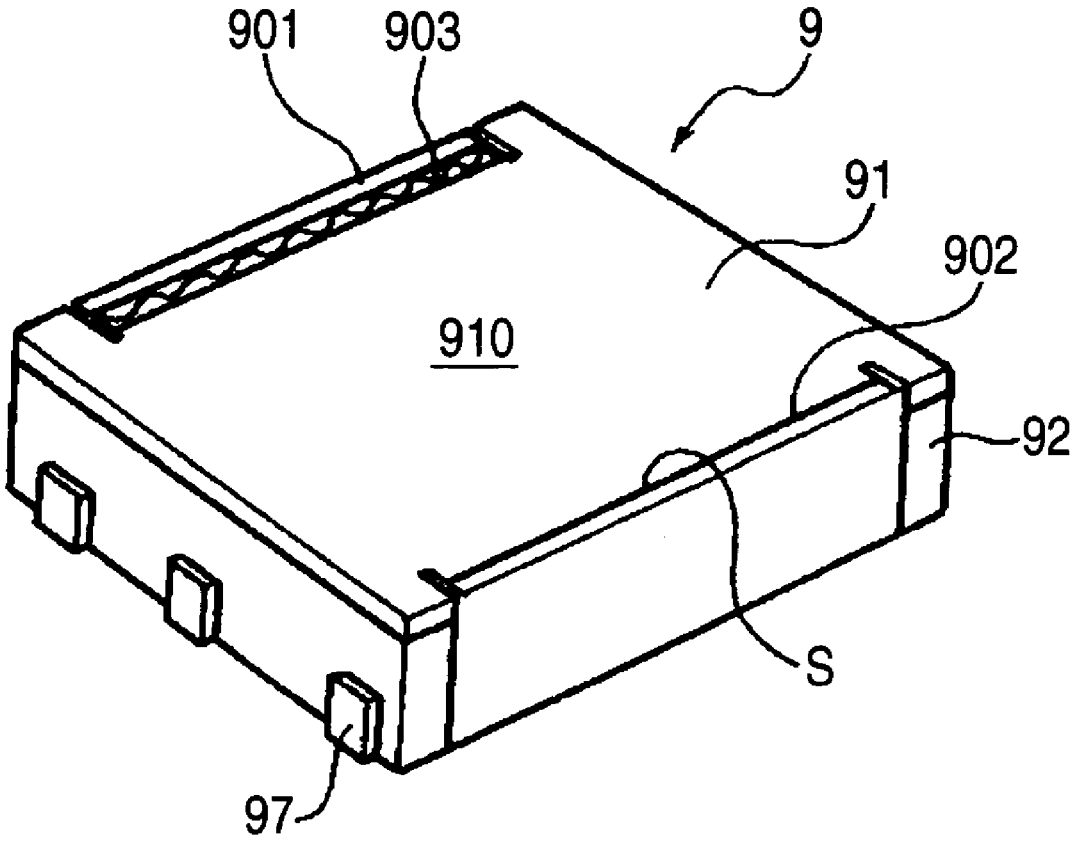
FIG. 1 is a perspective view showing an embodiment of a non-reciprocal circuit element according to the invention.
Figure 2:
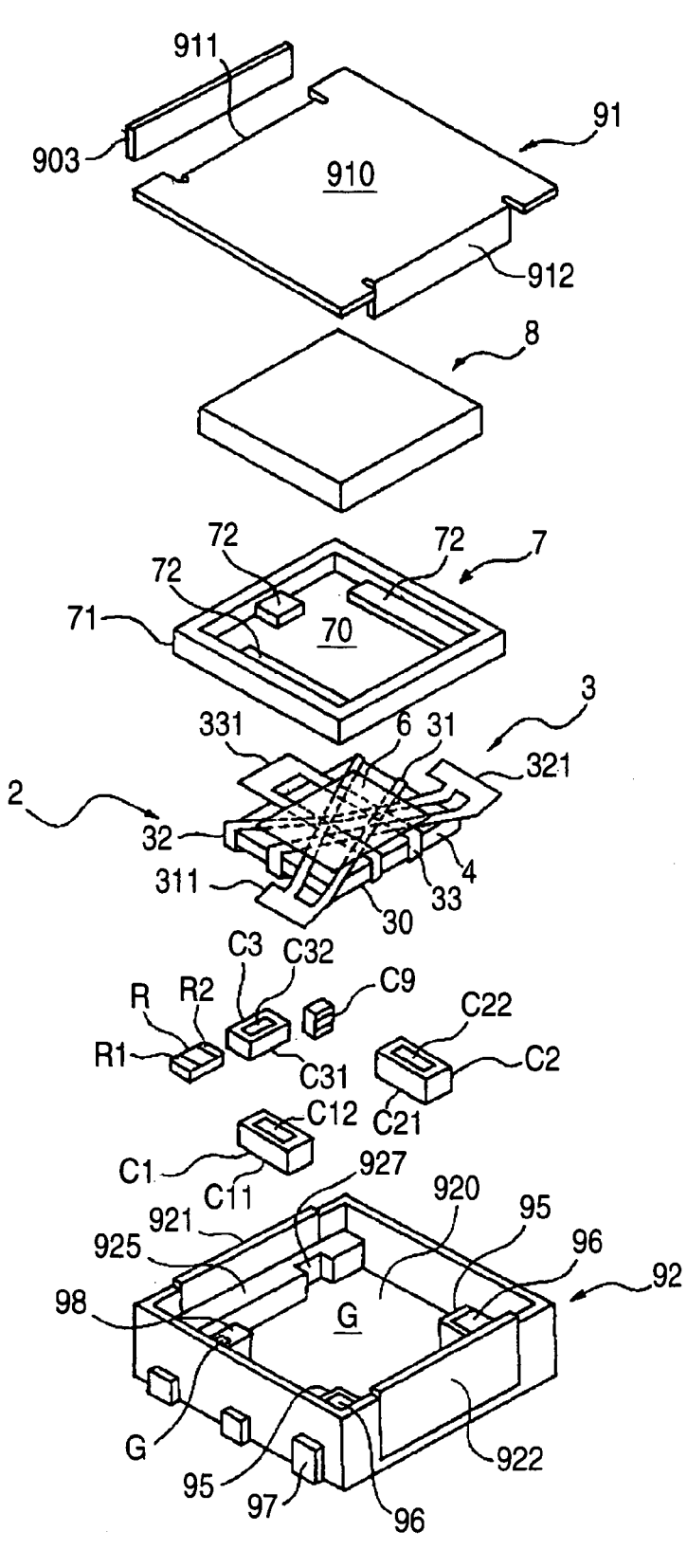
FIG. 2 is an exploded perspective view of the non-reciprocal circuit element shown in FIG. 1.
Figure 5:
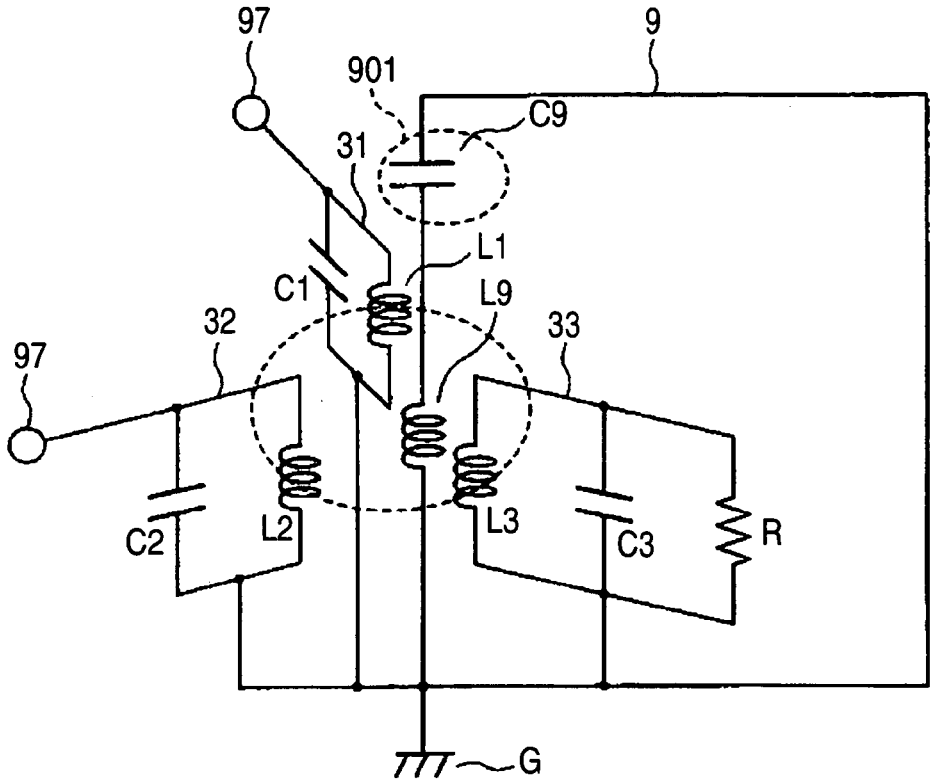
FIG. 5 is a circuit diagram of an isolator.

FIG. 1 is a perspective view showing an embodiment of a non-reciprocal circuit element according to the invention. FIG. 2 is an exploded perspective view of the non-reciprocal circuit element shown in FIG. 1. FIG. 3 is an exploded perspective view of a lower casing in the non-reciprocal circuit element shown in FIGS. 1 and 2. FIG. 4 is a schematic sectional view of the non-reciprocal circuit element shown in FIGS. 1 to 3. The illustrated non-reciprocal circuit element is constituted as an isolator by way of example. FIG. 5 is an equivalent circuit diagram of the isolator.

The illustrated non-reciprocal circuit element includes a magnetic rotor 2, a permanent magnet 8 and a casing 9. Further, the non-reciprocal circuit element includes a plurality of matching capacitors C1 to C3, a terminating resistor R., a coupling capacitor C9, and a pressure member 7.

The casing 9 includes an upper casing 91 and a lower casing 92, which are designed to include a magnetic metal material. The lower casing 92 includes a conductive magnetic metal material and an electrically insulating resin material. The lower casing 92 is formed into a quadrangular box-like shape whose top portion is open. As shown in FIG. 3, two opposed sides of a substantially quadrangular magnetic metal plate are bent by press or the like so as to be formed into a sectionally U-shape having rising sides 921 and 922 rising from a bottom plate 920. This is molded integrally with an electrically insulating resin material by use of a resin mold forming technique or the like. Thus, the lower casing 92 is formed. Alternatively, the lower casing 92 can be formed by molding an electrically insulating resin material portion and a magnetic metal material portion into frame-like shapes in advance and combining and integrating them with each other.

The magnetic metal material portion of the lower casing 92 has the bottom plate 920, and metal exposure portions in the opposed rising sides 921 and 922. The bottom plate 920 serves as ground G. The opposed rising sides 921 and 922 form coupling portions 901 and 902 to be coupled with the upper casing 91. The electrically insulating resin material portion includes bridging pieces 925 and 926, a high step portion 95 for placing an input/output electrode thereon, a high step portion 98 for placing a terminating resistor thereon, and an input/output external terminal 97. The bridging pieces 925 and 926 couple two opposed sides of the electrically insulating resin material portion. A recess portion 927 for placing a capacitor thereon is formed in one bridging piece 925. The coupling capacitor C9 is disposed in the recess portion 927.

The high step portion 95 for placing an input/output electrode thereon is set substantially on the same height as the thickness of the soft ferrite substrate 4 forming the magnetic rotor 2. An input/output electrode 96 is placed on the upper surface of the high step portion 95. The input/output electrode 96 is extracted to the electrically insulating resin material portion on the outer surface side of the lower casing 92 so as to serve as the input/output external terminal 97. The high step portion 98 for placing a terminating resistor thereon is set so that the upper surface of the terminating resistor R. will be substantially as high as the thickness of the soft ferrite substrate 4 when the terminating resistor R. is placed. The ground G is extracted onto the upper surface of the high step portion 98.

Each matching capacitor C1-C3 is formed into a rectangular parallelepiped, having substantially the same thickness as the thickness of the soft ferrite substrate 4. The matching capacitors C1 to C3 have external electrodes C11 to C32 on their thickness-direction opposite end surfaces respectively. The matching capacitors C11 to C32 are disposed along the side wall of the lower casing 92 so that the thickness direction of each capacitor is parallel to the thickness direction of the soft ferrite substrate 4. One-side external electrodes C11 to C31 are connected to the ground G by soldering S.

The terminating resistor R. can be constituted by a general-purpose chip resistor in which external electrodes R1 and R2 are formed on the opposite sides of a resistive element. The terminating resistor R. is placed on the high step portion 98 for placing a terminating resistor thereon. One electrode R1 is connected to the ground G extracted onto the upper surface of the high step portion 98 by soldering S.

The magnetic rotor 2 includes the central electrode 3, the soft ferrite substrate 4 and a tacky insulation sheet 6. The magnetic rotor 2 is received in the lower casing 92. The soft ferrite substrate 4 is preferably made of a soft magnetic material such as yttrium/iron/garnet (YIG). The soft ferrite substrate 4 is formed into a flat plate about 2 mm square and about 0.1-0.5 mm thick.

The central electrode 3 includes a ground portion 30 and first to third central conductors 31 to 33. For example, the central electrode 3 is formed out of a conductor plate obtained by punching a copper plate about 30 μm thick.

The ground portion 30 has a substantially square shape about 2 mm square in the same manner as the plate surface of the soft ferrite substrate 4. The ground portion 30 is disposed in opposition to the lower surface of the soft ferrite substrate 4.

The first to third central conductors 31 to 33 are extracted from the edge sides of the ground portion 30 so as to cross one another at a predetermined angle, for example, at an angle of 120 degrees on the surface of the soft ferrite substrate 4. The extracted central conductors 31 to 33 are bent in turn onto the upper surface of the soft ferrite substrate 4 through the insulation sheet 6 so as to be insulated from one another and to cross one another at the predetermined angle. The insulating sheet 6 is also laid on the third central conductor 33 located on top. The front ends of the first to third central conductors 31 to 33 are formed to project from the side ends of the upper surface of the soft ferrite substrate 4 so as to serve as connecting terminal portions 311 to 331 for connecting with the matching capacitors C1 to C3, the terminating resistor R., the input/output electrode 96, etc.

The magnetic rotor 2 is disposed in a central portion of the lower casing 92. The ground portion 30 is connected to the ground G by soldering S. The connecting terminal portions 311 and 321 of the first and second central conductors 31 and 32 are connected to the other-side external electrodes C12 and C22 of the matching capacitors C1 and C2 by soldering S, and also connected to the input/output electrode 96 by soldering S. The connecting terminal portion 331 of the third central conductor 33 is connected to the other-side external electrode C32 of the matching capacitor C3 by soldering S, and also connected to the other external electrode R2 of the terminating resistor R. by soldering S.

The pressure member 7 is made of an insulating material such as engineering plastics. The pressure member 7 includes a cavity portion 70, a frame portion 71 and pressure pieces 72. The cavity portion 70 is formed to be surrounded by the frame portion 71. The permanent magnet 8 is disposed in the cavity portion 70. The pressure pieces 72 are formed to project from the frame portion 71 so as to receive the permanent magnet 8. In addition, the pressure pieces 72 are received in the lower casing 92 so as to press and position the matching capacitors C1 to C3 and the terminating resistor R. through the terminal portions 311 to 331 of the first to third central conductors 31 to 33.

The permanent magnet 8 is formed into a flat plate which can be received in the cavity portion 70. The permanent magnet 8 is disposed to overlap the magnetic rotor 2 so as to apply a DC magnetic field to the magnetic rotor 2.

The upper casing 91 is formed as follows. That is, two opposed sides of a substantially quadrangular magnetic metal plate are bent by press or the like so as to be formed into a sectionally U-shape having falling sides 911 and 912 falling from a top plate 910. The opposed falling sides 911 and 912 form coupling portions 901 and 902 which will be coupled with the lower casing 92. The upper casing 91 is combined with the lower casing 92 so as to overlap the permanent magnet 8 and close the opening of the lower casing 92. The upper casing 91 and the lower casing 92 are magnetically coupled with the permanent magnet 8 so as to form a yoke. Each coupling portion 901, 902 is formed in a direction crossing the magnetic circuit of the yoke so as to couple the yoke in a direction of the magnetic circuit.

The coupling portions 901 and 902 include a capacitance element which has high impedance in response to a DC current and has low impedance in response to a high frequency current. In this embodiment, one coupling portion 901 includes an insulation sheet 903 and a coupling capacitor C9. The insulation sheet 903 is disposed in a portion where the rising side 921 and the falling side 911 overlap each other. Thus the rising side 921 and the falling side 911 are insulated from each other in terms of DC. The coupling capacitor C9 is disposed in the recess portion 927 for placing a capacitor thereon. The coupling capacitor C9 is connected between the bottom plate 920 of the lower casing 92 and the front end of the falling side 911 of the upper casing 91 by soldering S. The lowering casing 92 and the upper casing 91 are coupled to have low impedance in response to a high frequency current. In the other coupling portion 902, overlapping portions of the rising side 922 and the falling side 912 are connected with each other by soldering S. Thus, the lowering casing 92 and the upper casing 91 are coupled electrically and magnetically.

An electrically equivalent circuit of the non-reciprocal circuit element configured as described above can be expressed as shown in FIG. 5. In FIG. 5, L1, L2 and L3 represent inductance components belonging to the first to third central conductors 31 to 33 respectively, and L9 and C9 represent an inductance component and a capacitance element component belonging to the casing 9 respectively. The capacitance element component is formed chiefly by the capacitor C9 included in one coupling portion 901.

In the non-reciprocal circuit element configured thus, the magnetic rotor 2 and the permanent magnet 8 are provided inside the casing 9. The casing 9 includes a magnetic metal material and is coupled with the permanent magnet 8 so as to form a yoke. Accordingly, around the magnetic rotor 2 and the permanent magnet 8, an orbiting circuit is formed in the direction of the magnetic circuit of the yoke. The permanent magnet 8 is disposed to overlap the magnetic rotor 2, and the magnetic rotor 2 includes the plural central conductors 31-32 and the soft ferrite substrate 4. Accordingly, when a high frequency signal is supplied to the plural central conductors 31-32, a high frequency current is induced in the casing 9 due to the inductance components L1-L3 belonging to the plural central conductors 31-33 and the inductance component L9 belonging to the casing 9.

The casing 9 includes the coupling portions 901 and 902 for coupling the upper casing 91 and the lower casing 92 in the direction crossing the magnetic circuit of the yoke. The one coupling portion 901 includes the insulation sheet 903 and the coupling capacitor C9. The insulation sheet 903 is disposed in the portion where the rising side 921 and the falling side 911 overlap each other. Thus, the two sides 921 and 911 are insulated from each other in terms of DC. The coupling capacitor C9 is connected between the bottom plate 920 of the lower casing 92 and the front end of the falling side 911 of the upper casing 91. Thus, the lower casing 92 and the upper casing 91 are coupled to have low impedance in response to a high frequency current. Accordingly, the capacitance element component of the coupling capacitor C9 is added to the inductance component L9 belonging to the casing 9 so that a resonance circuit is formed in the casing 9. The non-reciprocal circuit element according to the invention is estimated to improve its electric characteristic due to this resonance circuit.

FIGS. 6-9 are graphs showing the electric characteristic of the non-reciprocal circuit element according to the invention as compared with that of a non-reciprocal circuit element having a background-art structure. In the non-reciprocal circuit element having the background-art structure, the lower casing 92 and the upper casing 91 are coupled by soldering S.

Figure 6:
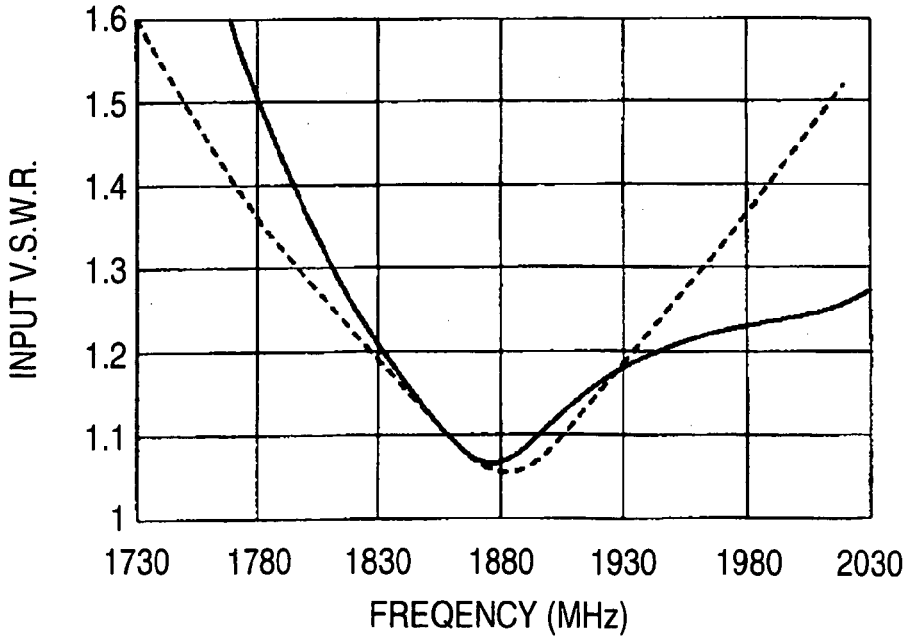
FIG. 6 is a graph showing the electric characteristic of the non-reciprocal circuit element according to the invention as compared with that of a non-reciprocal circuit element having a background-art structure.
Figure 7:
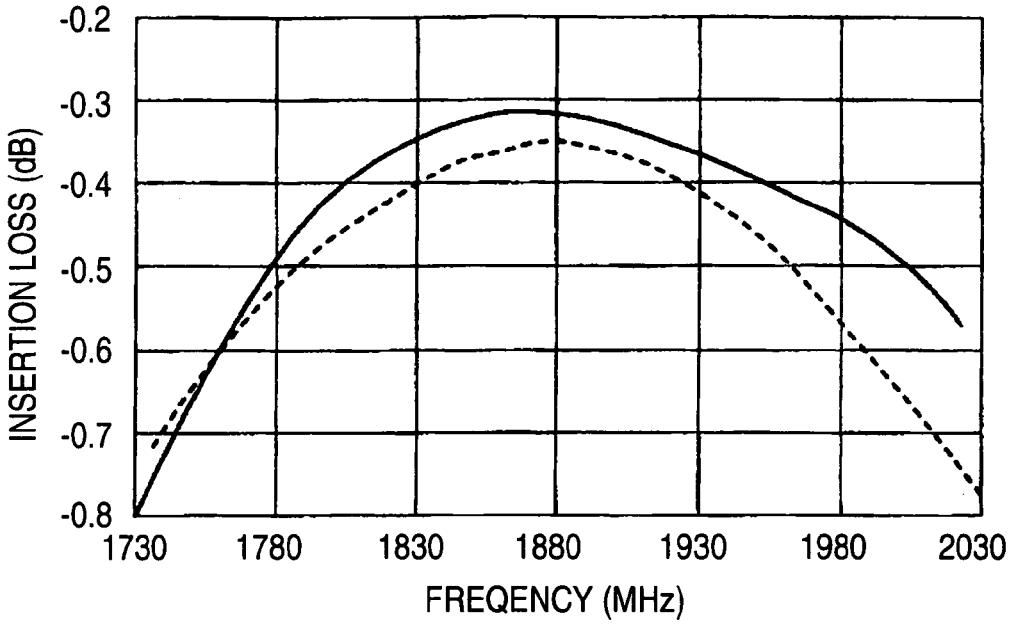
FIG. 7 is a graph showing the electric characteristic of the non-reciprocal circuit element according to the invention as compared with that of the non-reciprocal circuit element having the background-art structure.

In FIGS. 6-9, the solid lines show the characteristic of the non-reciprocal circuit element according to the invention, and the broken lines show the characteristic of the non-reciprocal circuit element having the background-art structure. FIGS. 6 and 7 are graphs showing input V.S.W.R. and insertion loss in each frequency respectively. As for the non-reciprocal circuit element according to the invention, each graph shows the characteristic when a low-temperature co-fired ceramic capacitor of 6 pF was used as the coupling capacitor C9. It is proved that in the non-reciprocal circuit element according to the embodiment, the input V.S.W.R. is improved, the insertion loss is reduced, and the operating frequency bandwidth is expanded. In such a manner, according to the invention, it is possible to obtain a non-reciprocal circuit element having an electric characteristic improved in view of insertion loss, input/output V.S.W.R., bandwidth, etc.

As for the coupling portions, the other coupling portion may be made to have a configuration similar to that of the one coupling portion. When the casing is circular or when the casing is made of a magnetic metal material as a whole, an annular coupling portion orbiting in a direction crossing the magnetic circuit may be provided. The coupling portion can be formed in any place of the top plate 910, the bottom plate 920, the middle portion of the rising, falling side 921, 911, etc. if the coupling portion is disposed in a direction crossing the magnetic circuit. In addition, the number of coupling portions is not limited especially. Further, when a capacitor element is included in each coupling portion, the portion where the coupling portions overlap each other does not have to be provided.

The capacitance element value of the capacitor varies in accordance with the shape, the size, the operating frequency band or the required characteristic of the non-reciprocal circuit element, and the capacitance element value is decided in accordance therewith.

The insulating member may have a shape other than a sheet-like shape. Without using the insulating member, an air gap may be used for performing the insulation in terms of DC. A non-conductive adhesive agent or the like may be used. The insulation sheet can be desired to include a tacky or adhesive layer in at least one side thereof. When the insulation sheet includes a tacky or adhesive layer, the insulation sheet can be firmly fixed to at least one of the coupling portions. Thus, the insulation sheet can be prevented from being displaced or detached. Further, when a non-conductive adhesive agent is used together, the bonding strength of the coupling portions can be enhanced.

Figure 8:
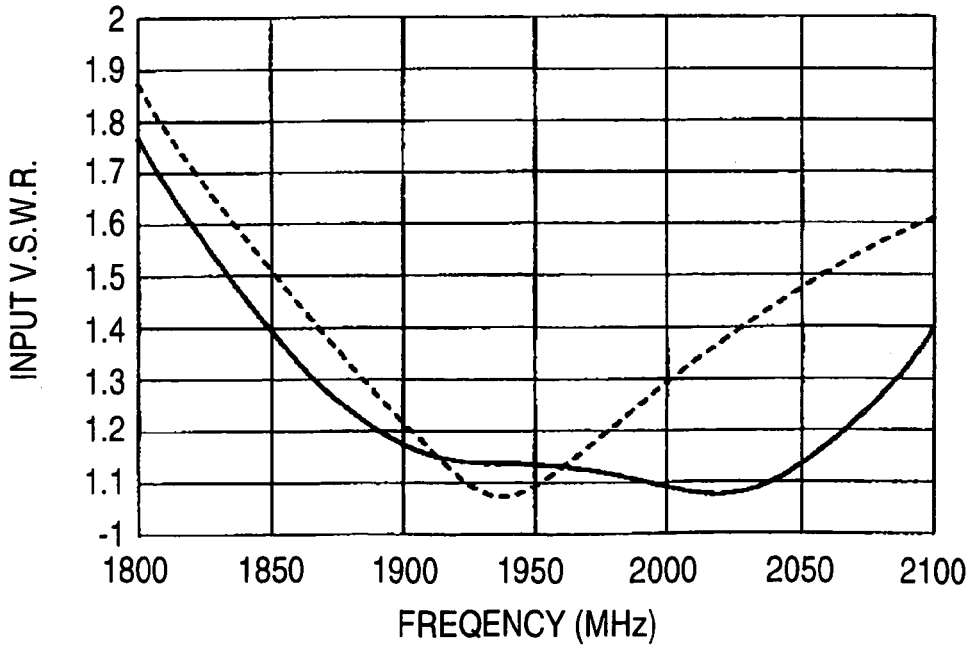
FIG. 8 is a graph showing the electric characteristic of the non-reciprocal circuit element according to the invention as compared with that of the non-reciprocal circuit element having the background-art structure.
Figure 9:
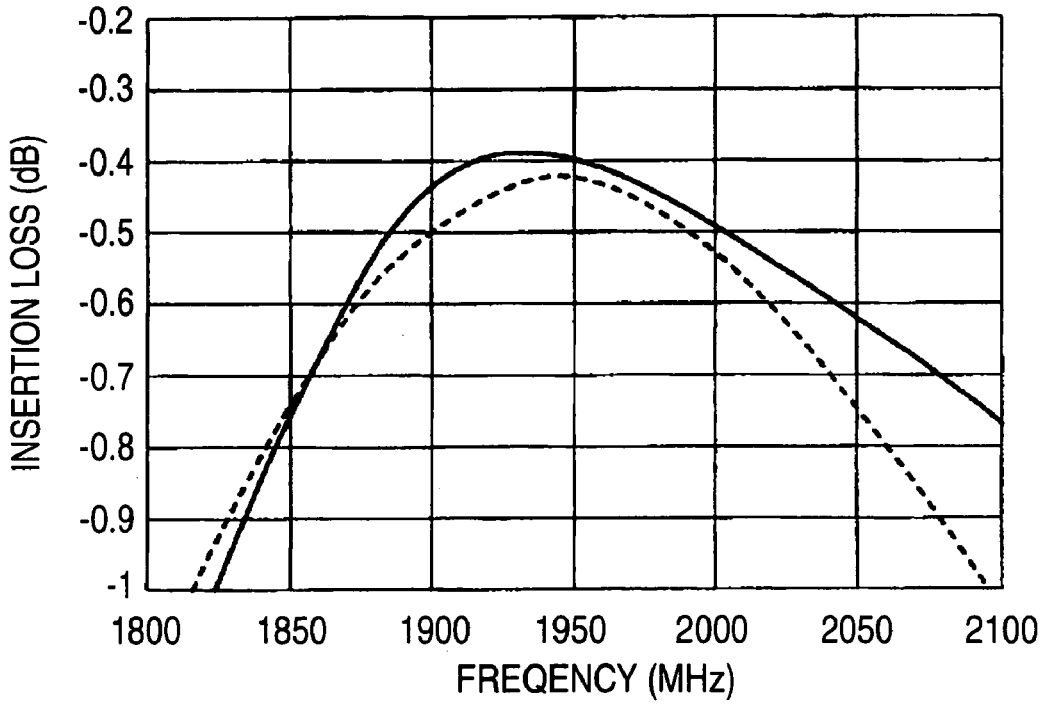
FIG. 9 is a graph showing the electric characteristic of the non-reciprocal circuit element according to the invention as compared with that of the non-reciprocal circuit element having the background-art structure.

FIGS. 8 and 9 are graphs showing the input V.S.W.R. and the insertion loss in this embodiment. The solid lines show the characteristic in the non-reciprocal circuit element according to this embodiment when a low-temperature co-fired ceramic capacitor of 2.7 pF was used as the coupling capacitor C9. The broken lines show the characteristic likewise when the coupling capacitor C9 was not added. It is proved that due to the addition of the capacitance element of the coupling capacitor C9, the input V.S.W.R. is improved, the insertion loss is reduced, and the operating frequency bandwidth is expanded.

Figure 10:
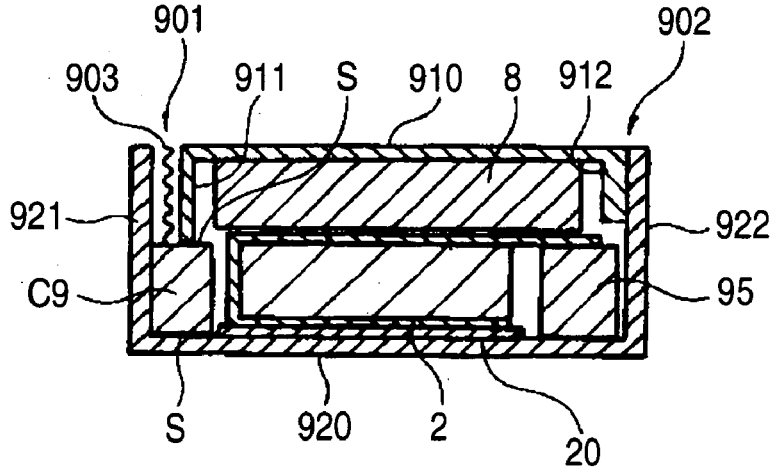
FIG. 10 is a schematic sectional view showing another embodiment of a non-reciprocal circuit element according to the invention.
Figure 11:
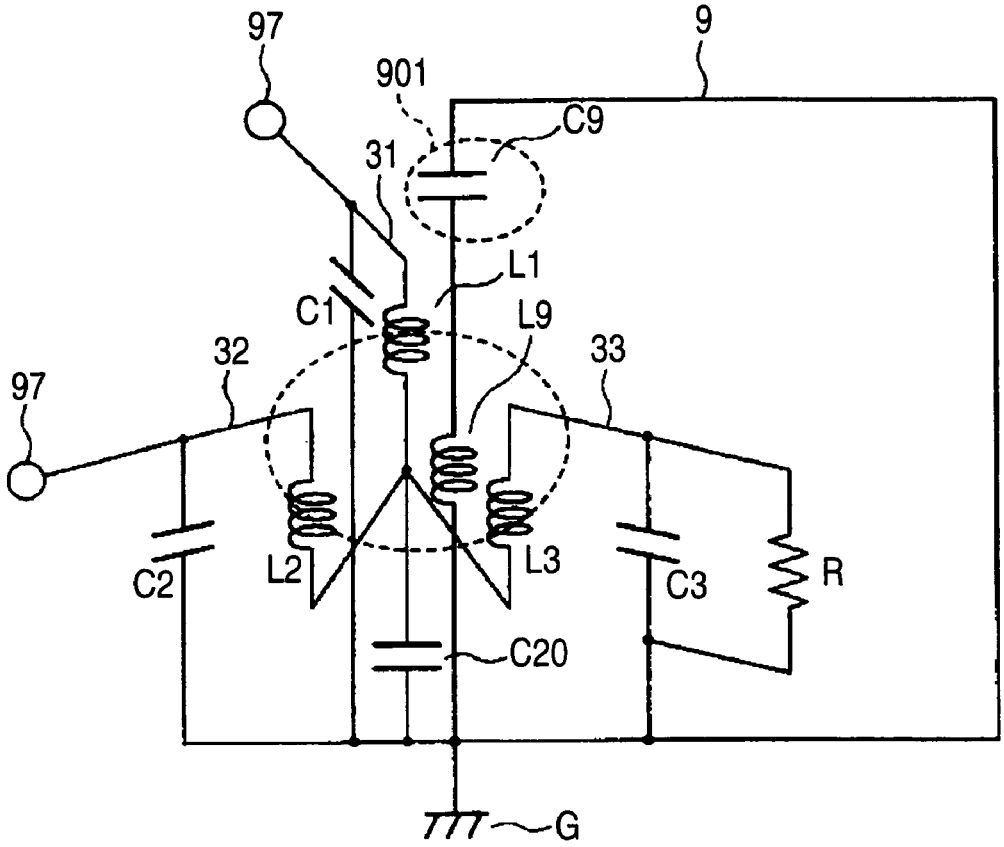
FIG. 11 is a circuit diagram of an isolator.

FIG. 10 is a schematic sectional view showing another embodiment of a non-reciprocal circuit element according to the invention. The illustrated non-reciprocal circuit element is constituted as an isolator by way of example. FIG. 11 is a circuit diagram of the isolator.

In the illustrated non-reciprocal circuit element, the magnetic rotor 2 is disposed on the ground G of the lower casing 92 through a dielectric sheet 20. The other parts are designed in the same manner as those in the non-reciprocal circuit element shown in FIGS. 1-4, and redundant description thereof will be omitted.

In the illustrated non-reciprocal circuit element, the magnetic rotor 2 is disposed on the ground G of the lower casing 92 through the dielectric sheet 20. Accordingly, an electrically equivalent circuit thereof can be expressed as shown in FIG. 11. In FIG. 11, C20 represents a capacitance element component depending on the dielectric sheet 20.

Since the non-reciprocal circuit element according to the embodiment has a capacitance element component caused by the dielectric sheet 20 between the magnetic rotor 2 and the ground G, the operating frequency and the applied magnetic field can be reduced simultaneously. When the operating frequency is reduced, a smaller-size magnetic rotor 2 can be used. When the applied magnetic field is reduced, a smaller-size permanent magnet 8 can be used. Thus, the non-reciprocal circuit element can be miniaturized.

The non-reciprocal circuit element according to this embodiment has a coupling portion 901 similar to that in the non-reciprocal circuit element shown in FIGS. 1-4. The coupling portion 901 includes a capacitance element which has high impedance in response to a DC current and have low impedance in response to a high frequency current. Accordingly, also in this embodiment, it is possible to obtain a non-reciprocal circuit element whose electric characteristic is improved in terms of insertion loss, input/output V.S.W.R., bandwidth, etc., in the same manner as the non-reciprocal circuit element shown in FIGS. 1-4.

Figure 12:
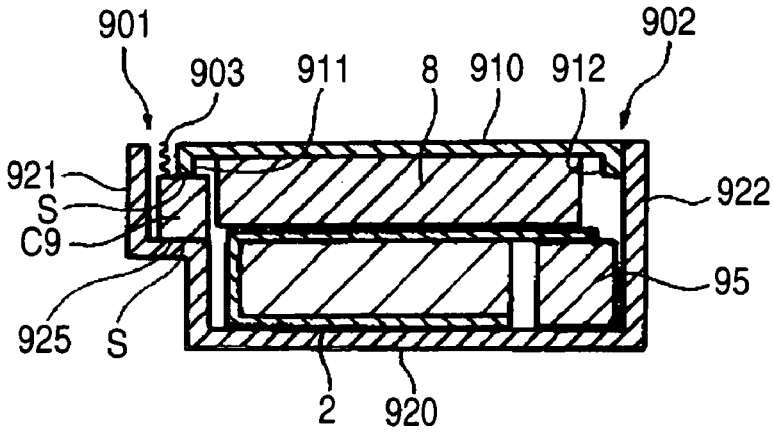
FIG. 12 is a schematic sectional view showing further another embodiment of a non-reciprocal circuit element according to the invention.

FIG. 12 is a schematic sectional view showing further another embodiment of a non-reciprocal circuit element according to the invention. In the illustrated non-reciprocal circuit element, the rising side 921 of the lower casing 92 is formed into a stepped shape in which a middle portion 925 is formed. The coupling capacitor C9 is made of a low-temperature co-fired ceramic capacitor, disposed on the middle portion 925, and connected to the ground G surface of the middle portion 925 and the front end of the falling side 911 by soldering S. Thus, the upper casing 91 and the lower casing 92 are coupled with each other. The other parts are designed in the same manner as those in the non-reciprocal circuit element shown in FIGS. 1-4, and redundant description thereof will be omitted.

The non-reciprocal circuit element according to this embodiment has a coupling portion 901 similar to that in the non-reciprocal circuit element shown in FIGS. 1-4. The coupling portion 901 includes a capacitance element which has high impedance in response to a DC current and have low impedance in response to a high frequency current. Accordingly, also in this embodiment, it is possible to obtain a non-reciprocal circuit element whose electric characteristic is improved in terms of insertion loss, input/output V.S.W.R., bandwidth, etc., in the same manner as the non-reciprocal circuit element shown in FIGS. 1-4. In addition, in the non-reciprocal circuit element according to this embodiment, the magnetic rotor 2 may be disposed on the ground G of the lower casing 92 through the dielectric sheet 20 in the same manner as in the non-reciprocal circuit element shown in FIGS. 10 and 11. In this case, the non-reciprocal circuit element can be miniaturized in the same manner as the non-reciprocal circuit element shown in FIGS. 1-4.

Figure 13:
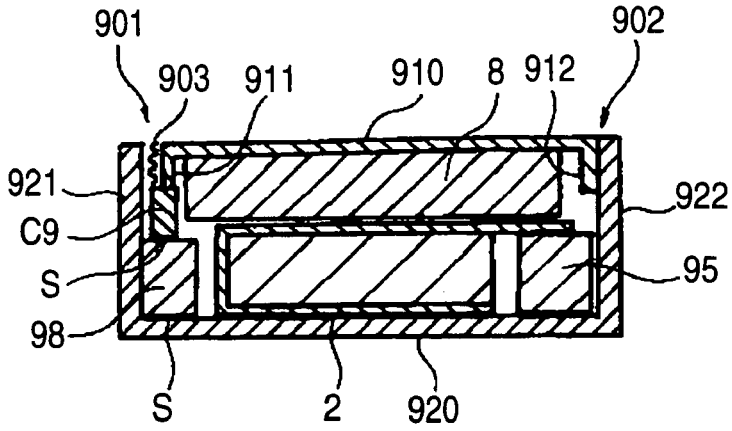
FIG. 13 is a schematic sectional view showing further another embodiment of a non-reciprocal circuit element according to the invention.

FIG. 13 is a schematic sectional view showing further another embodiment of a non-reciprocal circuit element according to the invention. The illustrated non-reciprocal circuit element includes a conductive high step portion 98. A coupling capacitor C9 is placed on the conductive high step portion 98. The other parts are designed in the same manner as those in the non-reciprocal circuit element shown in FIGS. 1-4, and redundant description thereof will be omitted.

The conductive step portion 98 is disposed near the rising side 921 of the bottom plate 920 of the lower casing 92. The coupling capacitor C9 is formed out of a multilayer chip capacitor. The coupling capacitor C9 is connected to the ground G and the front end of the falling side 911 through the conductive high step portion 98 by soldering S. Thus, the upper casing 91 and the lower casing 92 are coupled with each other.

The non-reciprocal circuit element according to this embodiment has a coupling portion 901 similar to that in the non-reciprocal circuit element shown in FIGS. 1-4. The coupling portion 901 includes a capacitance element which has high impedance in response to a DC current and has low impedance in response to a high frequency current. Accordingly, also in this embodiment, it is possible to obtain a non-reciprocal circuit element having an electric characteristic improved in terms of insertion loss, input/output V.S.W.R., bandwidth, etc., in the same manner as the non-reciprocal circuit element shown in FIGS. 1-4. In addition, in the non-reciprocal circuit element according to this embodiment, the magnetic rotor 2 may be disposed on the ground G of the lower casing 92 through the dielectric sheet 20 in the same manner as in the non-reciprocal circuit element shown in FIGS. 10 and 11. In this case, the non-reciprocal circuit element can be miniaturized in the same manner as the non-reciprocal circuit element shown in FIGS. 1-4.

Figure 14:
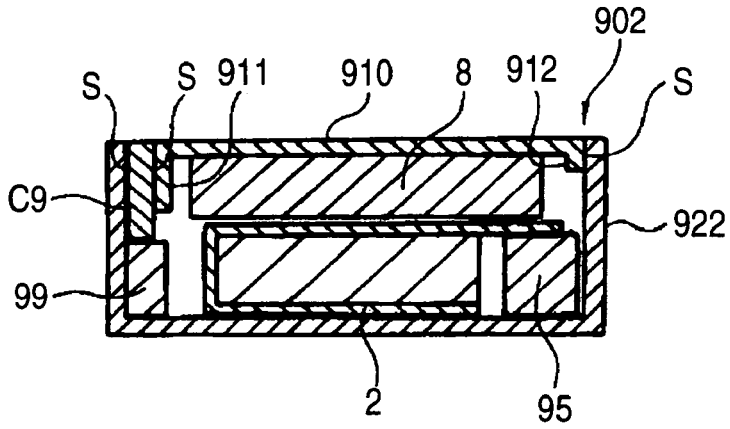
FIG. 14 is a schematic sectional view showing further another embodiment of a non-reciprocal circuit element according to the invention.
Figure 15:
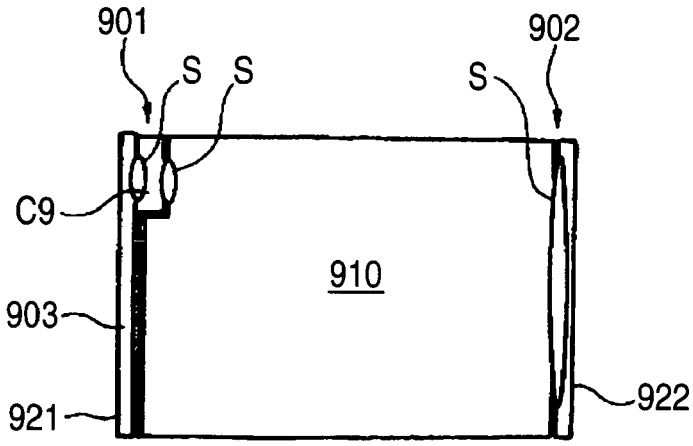
FIG. 15 is a schematic sectional view showing further another embodiment of a non-reciprocal circuit element according to the invention.

FIG. 14 is a schematic sectional view showing further another embodiment of a non-reciprocal circuit element according to the invention. FIG. 15 is a plan view thereof.

The illustrated non-reciprocal circuit element includes a high step portion 99 for placing a capacitor thereon. The high step portion 99 is made of an electrically insulating resin material. A coupling capacitor C9 is formed out of a single-plate capacitor and placed on the high step portion 99 for placing a capacitor thereon. The other parts are designed in the same manner as those in the non-reciprocal circuit element shown in FIGS. 1-4, and redundant description thereof will be omitted.

The high step portion 99 for placing a capacitor thereon is integrated with the electrically insulating resin material of the lower casing 92, and formed near the rising side 921 of the bottom plate 920 of the lower casing 92. The coupling capacitor C9 is formed out of a single-plate capacitor. In the single-plate capacitor, external electrodes are formed in the opposite plate surfaces thereof Accordingly, the coupling capacitor C9 is retained between the rising side 921 and the falling side 911, and disposed on the high step portion 99 for placing a capacitor thereon. Thus, one coupling portion 901 includes a wide portion and a narrow portion.

The coupling capacitor C9 is disposed on the wide portion of the one coupling portion 901. The external electrodes of the coupling capacitor C9 are connected to the plate surface of the rising side 921 and the plate surface of the falling side 911 by soldering S respectively. Thus, the upper casing 91 and the lower casing 92 are coupled with each other. An insulation sheet 903 is disposed on the narrow portion of the one coupling portion 901 so as to insulate the upper casing 91 and the lower casing 92 from each other. Incidentally, the narrow portion of the one coupling portion 901 may be bonded by use of a non-conductive adhesive agent without using the insulation sheet 903. Alternatively, the one coupling portion 901 may be wholly formed out of a wide portion so that the upper casing 91 and the lower casing 92 are insulted from each other through an air gap without using the insulation sheet 903.

The non-reciprocal circuit element according to this embodiment has a coupling portion 901 similar to that in the non-reciprocal circuit element shown in FIGS. 1-4. The coupling portion 901 includes a capacitance element which has high impedance in response to a DC current and has low impedance in response to a high frequency current. Accordingly, also in this embodiment, it is possible to obtain a non-reciprocal circuit element having an electric characteristic improved in terms of insertion loss, input/output V.S.W.R., bandwidth, etc., in the same manner as the non-reciprocal circuit element shown in FIGS. 1-4. In addition, in the non-reciprocal circuit element according to this embodiment, the magnetic rotor 2 may be disposed on the ground G of the lower casing 92 through the dielectric sheet 20 in the same manner as in the non-reciprocal circuit element shown in FIGS. 10 and 11. In this case, the non-reciprocal circuit element can be miniaturized in the same manner as the non-reciprocal circuit element shown in FIGS. 1-4.

Figure 16:
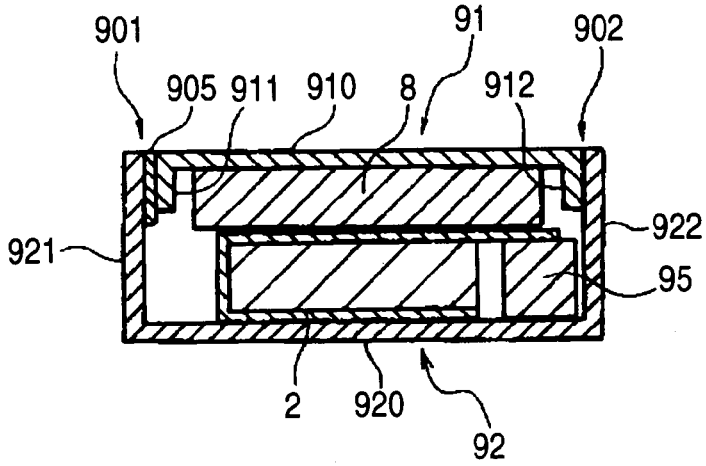
FIG. 16 is a schematic sectional view showing further another embodiment of a non-reciprocal circuit element according to the invention.

FIG. 16 is a schematic sectional view showing further another embodiment of a non-reciprocal circuit element according to the invention. In the illustrated non-reciprocal circuit element, the one coupling portion 901 includes no coupling capacitor element. The capacitance element of the one coupling portion 901 is formed out of a dielectric sheet 905. The other parts are designed in the same manner as those in the non-reciprocal circuit element shown in FIGS. 1-4, and redundant description thereof will be omitted.

In the illustrated non-reciprocal circuit element, the falling side 911 of the upper casing 91 and the rising side 921 of the lower casing 92 include overlapping portions respectively. The overlapping portions are coupled with each other through the dielectric sheet 905.

The capacitance element of the one coupling portion 901 is formed between the opposed surfaces overlapping each other through the dielectric sheet 905. Accordingly, when the opposed area of the overlapping portions is set, the capacitance element value can be adjusted.

The dielectric sheet 905 can be provided all over the rising side 921. When the dielectric sheet 905 is provided all over the rising side 921, the dielectric sheet 905 can be positioned easily so that the dielectric sheet 905 can be prevented from being detached. The dielectric sheet 905 may include a tacky or adhesive layer in at least its one surface. When the dielectric sheet 905 includes a tacky or adhesive layer, the dielectric sheet 905 can be firmly fixed to at least one of the falling side 911 and the rising side 921. Thus, the dielectric sheet 905 can be prevented from being displaced or detached. Further, when a non-conductive adhesive agent is used together, the coupling strength of the coupling portion 901 can be enhanced.

As the dielectric sheet 905, a sheet of Teflon (registered trade mark), polyimide or the like with a low dielectric loss tangent is suitable. In addition, a polyimide sheet is excellent in terms of availability. A polyimide sheet about 12.5 μm thick will be about 27.5 μm thick if a tacky or adhesive layer is included. Thus, polyimide is particularly suitable because a thin sheet can be obtained.

The non-reciprocal circuit element according to this embodiment includes no coupling capacitor element. Accordingly, the configuration of the non-reciprocal circuit element can be simplified.

The non-reciprocal circuit element according to this embodiment has a coupling portion 901 similar to that in the non-reciprocal circuit element shown in FIGS. 1-4. The coupling portion 901 includes a capacitance element which has high impedance in response to a DC current and has low impedance in response to a high frequency current. Accordingly, also in this embodiment, it is possible to obtain a non-reciprocal circuit element having an electric characteristic improved in terms of insertion loss, input/output V.S.W.R., bandwidth, etc., in the same manner as the non-reciprocal circuit element shown in FIGS. 1-4. In addition, in the non-reciprocal circuit element according to this embodiment, the magnetic rotor 2 may be disposed on the ground G of the lower casing 92 through the dielectric sheet 20 in the same manner as in the non-reciprocal circuit element shown in FIGS. 10 and 11. In this case, the non-reciprocal circuit element can be miniaturized in the same manner as the non-reciprocal circuit element shown in FIGS. 1-4.

Figure 17:
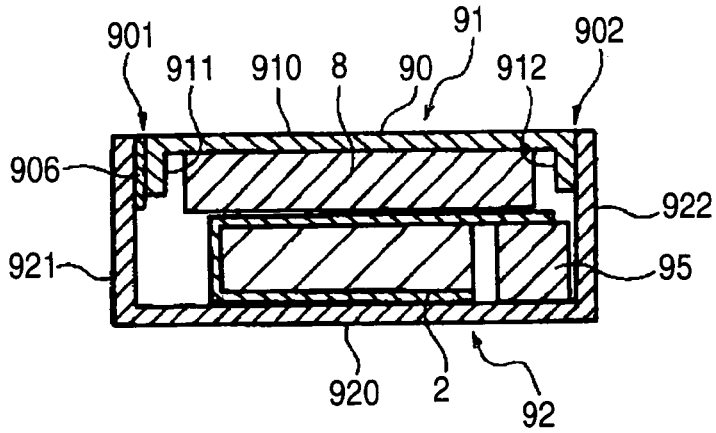
FIG. 17 is a schematic sectional view showing further another embodiment of a non-reciprocal circuit element according to the invention.

FIG. 17 is a schematic sectional view showing further another embodiment of a non-reciprocal circuit element according to the invention. In the illustrated non-reciprocal circuit element, the one coupling portion 901 includes no coupling capacitor element. The capacitance element of the one coupling portion 901 is formed out of an insulating coating layer 906. The other parts are designed in the same manner as those in the non-reciprocal circuit element shown in FIGS. 1-4, and redundant description thereof will be omitted.

In the illustrated non-reciprocal circuit element, the falling side 911 of the upper casing 91 and the rising side 921 of the lower casing 92 include overlapping portions respectively. The insulating coating layer 906 is applied to at least one of the falling side 911 and the rising side 921.

The capacitance element of the one coupling portion 901 is formed between the opposed surfaces overlapping each other through the insulating coating layer 906. Accordingly, when the opposed area of the overlapping portions is set, the capacitance element value can be adjusted.

Resin formed on the rising side 921 in advance in a method such as a coating method or a vapor method of CVD or the like and having an excellent dielectric characteristic is used as the insulating coating layer 906.

The non-reciprocal circuit element according to this embodiment includes no coupling capacitor element. Accordingly, the configuration of the non-reciprocal circuit element can be simplified.

The non-reciprocal circuit element according to this embodiment has a coupling portion 901 similar to that in the non-reciprocal circuit element shown in FIGS. 1-4. The coupling portion 901 includes a capacitance element which has high impedance in response to a DC current and has low impedance in response to a high frequency current. Accordingly, also in this embodiment, it is possible to obtain a non-reciprocal circuit element having an electric characteristic improved in terms of insertion loss, input/output V.S.W.R., bandwidth, etc., in the same manner as the non-reciprocal circuit element shown in FIGS. 1-4. In addition, in the non-reciprocal circuit element according to this embodiment, the magnetic rotor 2 may be disposed on the ground G of the lower casing 92 through the dielectric sheet 20 in the same manner as in the non-reciprocal circuit element shown in FIGS. 10 and 11. In this case, the non-reciprocal circuit element can be miniaturized in the same manner as the non-reciprocal circuit element shown in FIGS. 1-4.

Figure 18:
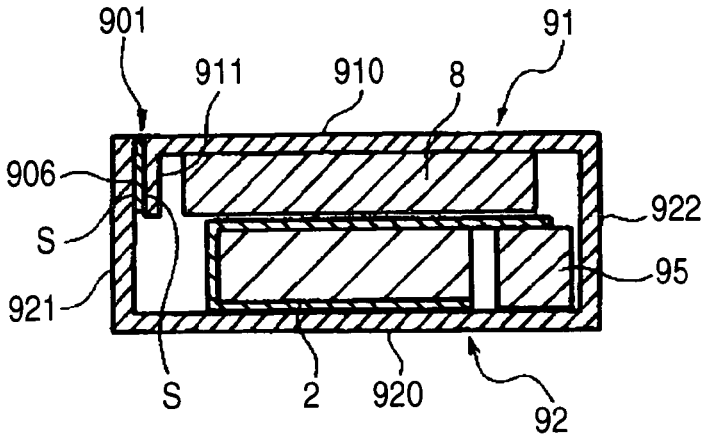
FIG. 18 is a schematic sectional view showing further another embodiment of a non-reciprocal circuit element according to the invention.
Figure 19:
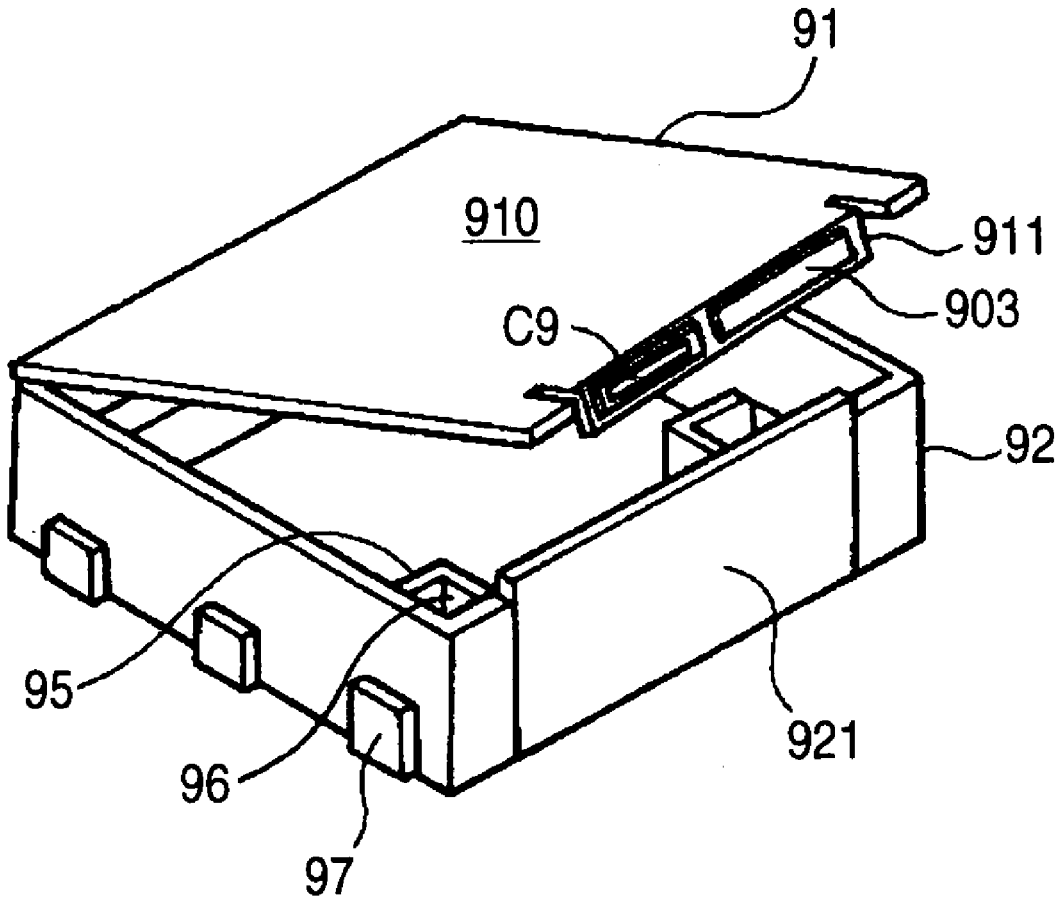
FIG. 19 is a perspective view of the non-reciprocal circuit element shown in FIG. 18, in which a casing is open.

FIG. 18 is a schematic sectional view showing further another embodiment of a non-reciprocal circuit element according to the invention. FIG. 19 is a perspective view of the non-reciprocal circuit element shown in FIG. 18, in which the casing 9 is open.

In the illustrated non-reciprocal circuit element, the casing 9 is not split into the upper casing 91 and the lower casing 92. The parts other than the casing 9 are similar to those in the non-reciprocal circuit element shown in FIGS. 1-4, and redundant description thereof will be omitted.

The casing 9 includes a lower casing 92 portion and a cover portion corresponding to the upper casing 91. The lower casing 92 portion and the cover portion corresponding to the upper casing 91 are continuous, and they are formed by bending a belt-like magnetic metal plate at four places. Each bent portion is formed to extend in the width direction of the belt-like magnetic metal plate, and bent at right angles. The bent portions in the opposite ends form the falling side 911 and the rising side 921 and form one coupling portion 901.

A coupling capacitor C9 and an insulation sheet 903 are disposed on the falling side 911. At least one of the coupling capacitor C9 and the insulation sheet 903 may be disposed on the rising side 921. The insulation sheet 903 may be large enough to cover all the height-direction surface of the rising side 921. Further, the insulation sheet 903 may include a tacky layer or an adhesive layer.

The coupling capacitor C9 is formed into a thin plate-like shape using a low-temperature co-fired ceramic substrate. External electrodes are formed on the opposed plate surfaces of the coupling capacitor C9. The external electrodes of the coupling capacitor C9 are connected to the opposed plate surfaces of the rising side 921 and the falling side 911 by soldering S respectively. In this embodiment, it is also preferable to use a single-plate capacitor as the coupling capacitor C9.

The one coupling portion 901 may be formed in a top plate 910 portion. The one-coupling portion 901 can be formed in the top plate 910 portion if the top plate 910 portion is formed as follows. That is, the positions of the four bent portions are shifted so that the bent portions in the opposite ends overlap each other. The casing 9 in this embodiment can be applied to the case where the capacitance element of the coupling portion 901 is formed out of a dielectric sheet without using any capacitor element.

The non-reciprocal circuit element according to this embodiment has a coupling portion 901 similar to that in the non-reciprocal circuit element shown in FIGS. 1-4. The coupling portion 901 includes a capacitance element which has high impedance in response to a DC current and has low impedance in response to a high frequency current. Accordingly, also in this embodiment, it is possible to obtain a non-reciprocal circuit element having an electric characteristic improved in terms of insertion loss, input/output V.S.W.R., bandwidth, etc., in the same manner as the non-reciprocal circuit element shown in FIGS. 1-4. In addition, in the non-reciprocal circuit element according to this embodiment, the magnetic rotor 2 may be disposed on the ground G of the lower casing 92 through the dielectric sheet 20 in the same manner as in the non-reciprocal circuit element shown in FIGS. 10 and 11. In this case, the non-reciprocal circuit element can be miniaturized in the same manner as the non-reciprocal circuit element shown in FIGS. 1-4.

The invention has been described in detail with reference to its preferred embodiments. However, the invention is not limited to the embodiments. It is obvious for those skilled in the art that various modifications can be conceived based on the basic technical ideas and instructions of the invention.

What is claimed is:

1. A non-reciprocal circuit element comprising a magnetic rotor, a permanent magnet and a casing, wherein:

said magnetic rotor includes a soft ferrite substrate and a plurality of central conductors, and is provided inside said casing;

said permanent magnet is provided inside said casing and disposed to overlap said magnetic rotor, so as to apply a DC magnetic field to said magnetic rotor;

said casing includes a magnetic metal material, and is coupled with said permanent magnet so as to form a yoke;

a coupling portion is formed in a direction crossing a magnetic circuit of said yoke so that said casing is coupled with said permanent magnet in a direction of said magnetic circuit through said coupling portion;

said coupling portion includes a capacitance element which has high impedance in response to a DC current and has low impedance in response to a high frequency current;

said coupling portion is formed to include overlapping portions of said magnetic metal material, wherein said overlapping portions are coupled through a dielectric sheet;

said capacitance element is formed between opposed surfaces overlapping each other through said dielectric sheet; and said dielectric sheet includes a tacky or adhesive layer in at least one side thereof, and is firmly fixed to at least one of said opposed surfaces.

2. The non-reciprocal circuit element according to claim 1, wherein said capacitance element includes a multilayer capacitor.

3. The non-reciprocal circuit element according to claim 1, wherein said capacitance element includes a low-temperature co-fired ceramic substrate.

4. The non-reciprocal circuit element according to claim 1, wherein said coupling portion is connected to include a non-conductive adhesive agent.

5. The non-reciprocal circuit element according to claim 1, further comprising a dielectric layer formed between said magnetic rotor and said casing.

6. The non-reciprocal circuit element according to claim 1, wherein said casing includes an upper casing and a lower casing; and said coupling portion is formed in a connection portion between said upper casing and said lower casing.

7. The non-reciprocal circuit element according to claim 6, wherein said upper casing includes a top plate made of a magnetic metal plate, and a falling side falling from said top plate;

said lower casing includes a bottom plate made of a magnetic metal plate, and a rising side rising from said bottom plate; and said coupling portion is formed in a connection portion between said falling side and said rising side.

* * * * *